United States Patent [19]

Horwitt

[11] 4,149,332

[45] Apr. 17, 1979

[54] EXTRUDED PICTURE FRAME MEMBERS

[76] Inventor: Nathan G. Horwitt, Lenox, Mass. 01240

[21] Appl. No.: 778,707

[22] Filed: Mar. 17, 1977

[51] Int. Cl.[2] ..... G09F 1/12

[52] U.S. Cl. ..... 40/155

[58] Field of Search ..... 40/152.1, 153, 155; 248/488, 490

[56] References Cited

U.S. PATENT DOCUMENTS

| | | | |
|---|---|---|---|
| 896,827 | 8/1908 | Hawkes | 40/155 |
| 2,209,972 | 8/1940 | Horwitt | 40/152.1 |
| 2,777,232 | 1/1957 | Kulicke et al. | 40/155 |
| 2,877,585 | 3/1959 | Horwitt | 40/152.1 |
| 3,255,630 | 6/1966 | Spector | 40/152.1 |
| 4,055,319 | 10/1977 | Pendock | 248/488 X |

FOREIGN PATENT DOCUMENTS

| | | | |
|---|---|---|---|
| 223050 | 12/1942 | Switzerland | 40/155 |

*Primary Examiner*—Russell R. Kinsey
*Assistant Examiner*—Wenceslao J. Contreras

[57] ABSTRACT

This invention comprises a plurality of extruded members, of metal or plastic, to form the frame for a picture. The back of each extruded member has a formed, flexible groove. This groove is adapted to receive securing means either in the form of special securing members, or a cord or wire, or both such types of securing means, which will hold a number of the members together to form a frame.

2 Claims, 16 Drawing Figures

EXTRUDED PICTURE FRAME MEMBERS

BACKGROUND OF THE INVENTION

This invention relates to picture frames, and more particularly, to a novel type of extruded picture frame member, which may be used to form a novel picture frame.

In the picture frame art, many types of frames are known. One of the known types are those ready made frames that come in various sizes for specific picture sizes. Other types of frames are known where certain pieces of wood or metal are purchased, either separately, or as a kit, and a desired frame is assembled from such pieces. Other types are known, where metal or plastic pieces are provided, which fit over portions of a picture and its backing, and are pulled snug with a string or the like, which also serves as a hanger.

It is considered desirable by those skilled in the picture frame art to provide a picture frame that is composed of a plurality of members that may be readily secured about a picture, which can be easily removed to use with another picture, and which is provided with easy means to secure the frame, and hang the picture. It has recently been discovered that a novel extruded member of either metal or plastic may be provided to form such a desired picture frame.

SUMMARY OF THE INVENTION

Briefly, in one form, this invention comprises a plurality of extruded members, of metal or plastic, to form the frame for a picture. The back of each extruded member has a formed, flexible groove, designed to receive securing means either in the form of special securing members, or a cord or wire, or both such types of securing means, which will hold a number of the members together to form a frame.

The invention which is sought to be protected will be particularly pointed out and distinctly claimed in the claims appended hereto. However, it is believed that this invention, and the manner in which its various objects and advantages are obtained, as well as other objects and advantages thereof, will be better understood from the following detailed description of the preferred embodiments thereof, especially when considered in the light of the accompanying drawings.

DESCRIPTION OF THE PREFERRED EMBODIMENTS

As earlier noted, this invention relates to a novel type of picture frame comprising a plurality of extruded members, which may be placed about the picture, and its backing and glass cover, if used. The drawings depict various types of preferred forms of extruded members, as well as various types of securing members which may be used with the extruded members. While the description will proceed with respect to such drawings, it will be readily understood by those skilled in the picture frame art, that such descriptions and drawings are used to explain the novel features of this invention, rather than in a limiting sense. As is understood, the scope of the invention is set forth in the appended claims.

Figure 3:
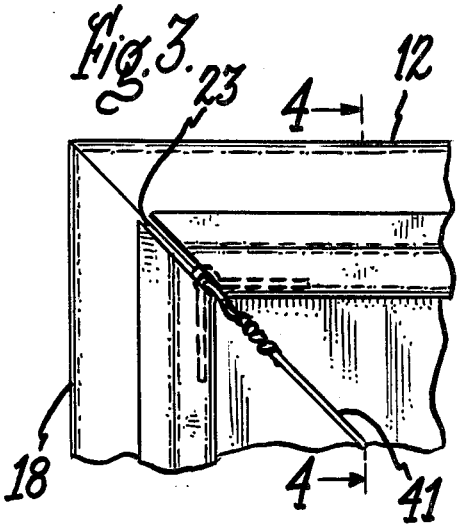
FIG. 3 is a partial, plan view, on an enlarged scale, similar to the upper left-hand corner of FIG. 1.
Figure 4:
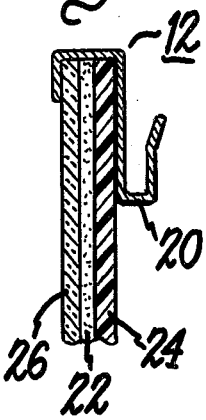
FIG. 4 is a sectional view taken on the line 4—4 of FIG. 3.
Figure 5:
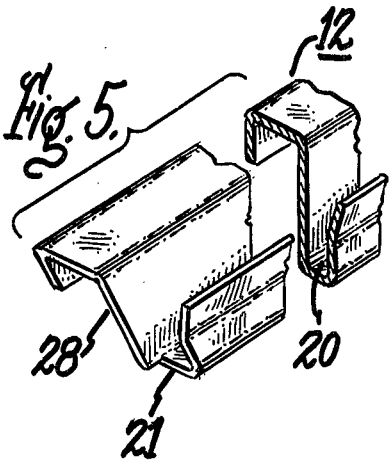
FIG. 5 is a partial perspective view, showing a portion of the extruded member according to the invention shown in FIGS. 1–4.

Referring first to FIGS. 1 through 5 of the drawings, a preferred embodiment of this invention will be described. As is shown in those FIGURES, a picture frame 10 is formed of a plurality of extruded frame members 12, 14, 16 and 18. Each of frame members 12, 14, 16 and 18 is formed in an extruded, substantially or generally Z-shape, with a groove 20 formed in the back of each frame member, as shown in FIGS. 4 and 5. As will be understood, each of the frame members 12, 14, 16 and 18, is extruded from either a plastic or metal material, to form a flexible, Z-shaped frame member, as shown. As is apparent, the frame members will slide over a picture, as well as the backing and the glass cover, if used, as is best shown in FIG. 4. As there shown, the picture 22, the backing 24 and the glass cover 26 are firmly held by the frame member 12. The frame members 12, 14, 16 and 18 may be provided in a special kit for a given size picture, or they may be sold separately and cut to the desired length, for example on a forty-five degree angle, as shown at 28 in FIG. 5. In either event, securing members will be provided to hold the frame members together about the picture and provide a means of hanging the picture.

Figure 1:
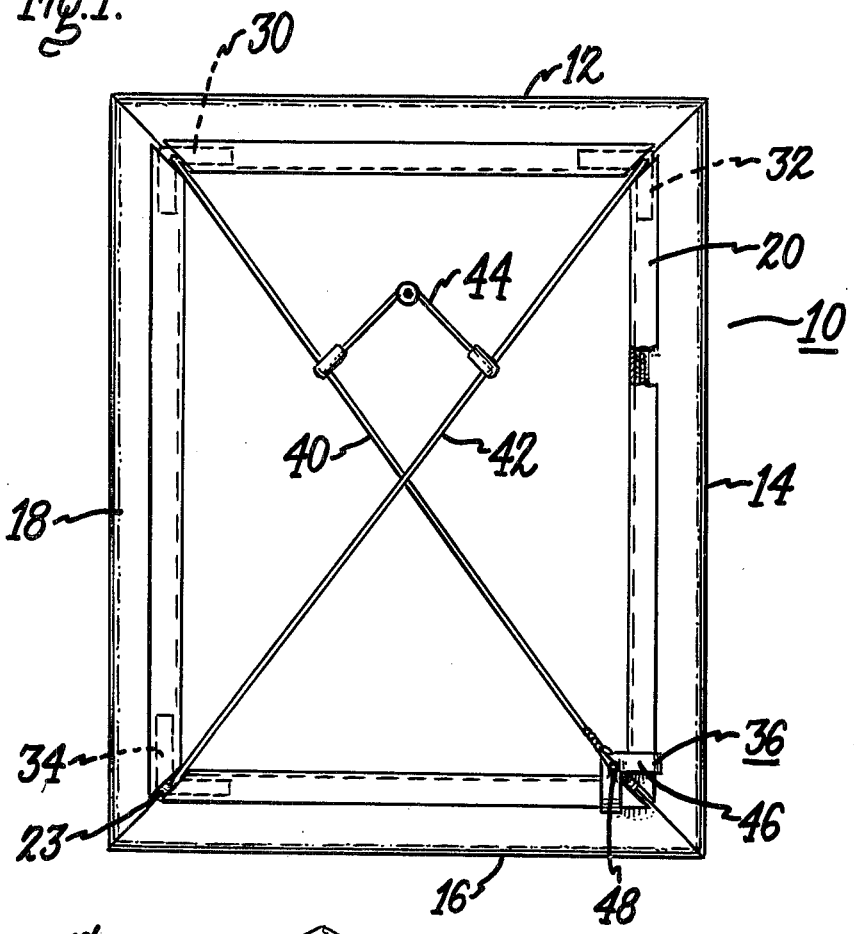
FIG. 1 is a plan view, with parts broken away, of the back of a picture frame, showing one form of extruded member according to this invention.
Figure 2:
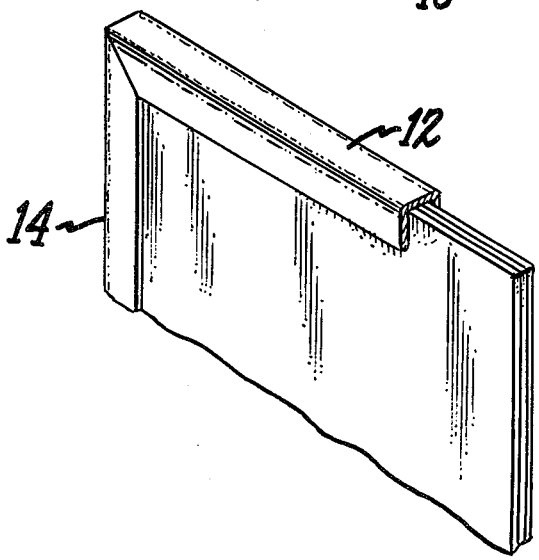
FIG. 2 is a partial perspective view, with parts broken away, showing a portion of the front of the frame of FIG. 1.

Various types of securing means may be used according to this invention. Some preferred types, according to the preferred embodiment of this invention, are shown in FIGS. 1 through 9. In FIGS. 1 and 7 one form of securing means is shown in the form of right-angled securing member 30 (and members 32 and 34) which fit in the grooves 20, as shown. As is clear from FIG. 1, the securing members 30, 32, and 34 are pressed into the flexible groove 20 between the members 12, 14, 16 and 18. As will be apparent, this forms the means to secure the frame members into the desired picture frame.

Figure 9:
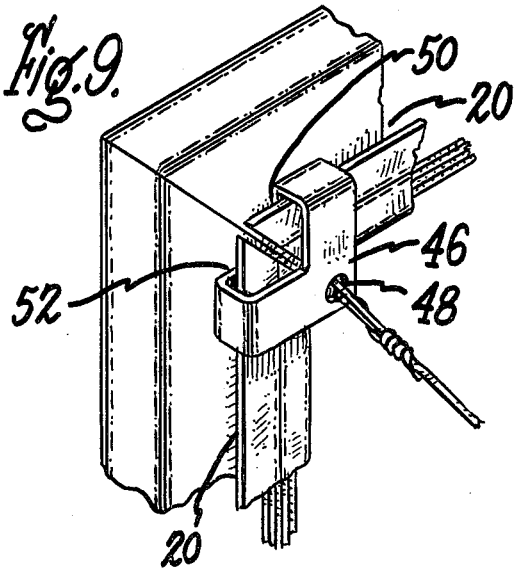
FIG. 9 is a partial perspective view of a corner of the extruded frame of this invention showing the use of the anchor clip of FIG. 8.

In the form shown in FIGS. 1 and 7, the securing members 30, 32 and 34 are provided with an opening 38, substantially at the apex of the right-angled member. A cord or wire member 40 is fastened between securing member 30 and an anchor 36, while cord or wire 42 is fastened between securing members 32, 34. As is shown in FIGS. 1, 3 and 5, the edge of groove 20 is cut back slightly, as at 21 (FIG. 5) to form slots 23, for cord or wire 40, 42. In the preferred form shown, a hanger member 44 is provided, attached to cord or wires 40, 42, in the manner shown particularly in FIG. 1. As is shown in FIG. 1, as well as in FIGS. 8 and 9, one of the securing members may be in the form of an anchor clip 36. As shown in FIG. 1, anchor clip 36 fits into groove 20, between extruded members 14 and 16, with portion 46, having opening 48, on the outside of groove 20. Anchoring tabs 50, 52 fit into the groove 20, on adjacent extruded members, as best shown in FIG. 9. When an anchor clip 36 is used, a single cord or wire may be used. One end is secured to opening 48 of anchor clip 36, as shown in FIG. 1, and extends to securing member 30, through opening 38 and back to clip 36. The cord or wire is then extended up groove 20 in member 14, and through opening 38 in securing means 32. The cord or wire then extends across to securing member 34, through opening 38 and back to member 32. Any remaining cord or wire can then be wrapped into the grooves 20 of the various extended members, as indicated in FIGS. 1 and 9. Of course, it will be understood that four securing members like 30 of FIG. 7, can be used, if desired.

Figure 6:
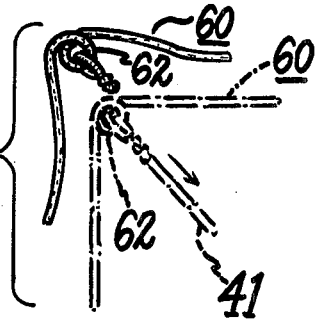
FIG. 6 is a plan view, on an enlarged scale, of the form of securing member shown in FIG. 3.
Figure 7:
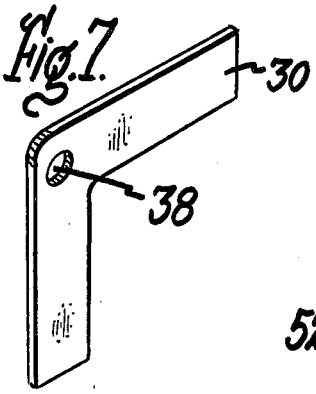
FIG. 7 is a perspective view, on an enlarged scale, of the form of securing member shown in FIG. 1.
Figure 8:
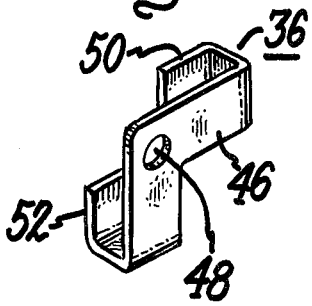
FIG. 8 is a perspective view of an anchor type securing means, as shown in FIGS. 1 and 9.

An alternate form of securing means is shown in FIGS. 3 and 6. As there shown, the securing means 60 is in the form of a flexible wire member bent at substantially a right angle and having a loop or bight 62 formed at the apex of member 60. As will be understood, bight 62 receives the cord or wire 41, as shown in FIGS. 3 and 6. Securing member 60 is pulled into the full right-angled shape, as shown in phantom lines in FIG. 6 when the cord or wire 41 is tightened about the various securing means 60 used in frame 10. As will be apparent, the flexible securing members 60 will aid in holding the cord or wire 41 taut, keeping the frame 10 secure.

Figure 10:
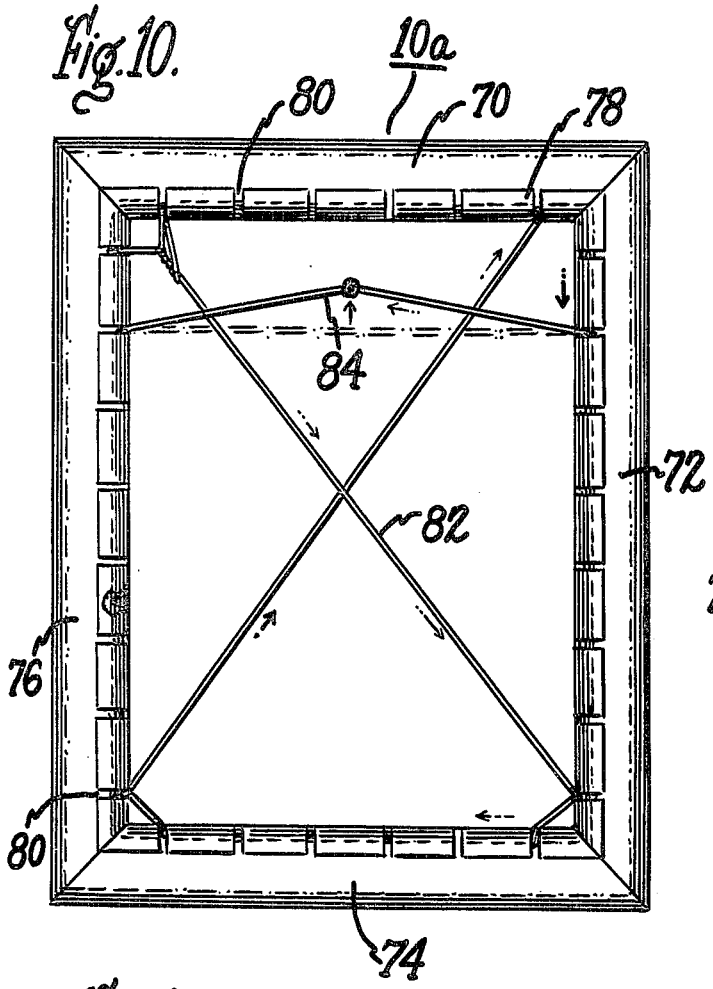
FIG. 10 is a rear plan view of a picture frame with another form of extruded member according to the invention.
Figure 11:
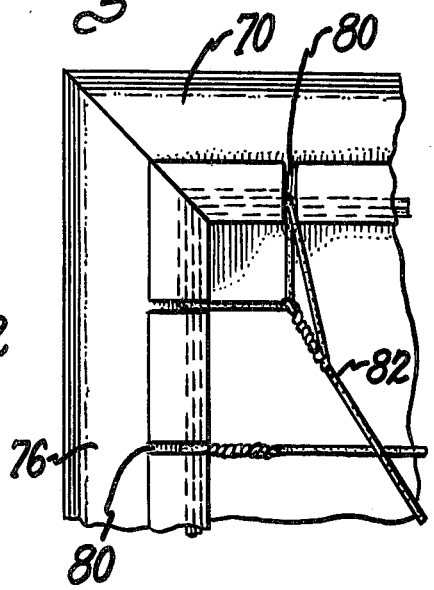
FIG. 11 is an enlarged showing of the upper left-hand corner of the frame of FIG. 10.
Figure 12:
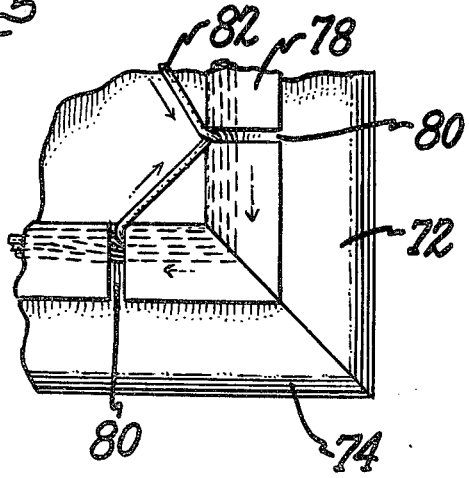
FIG. 12 is an enlarged showing of the lower right-hand corner of the frame of FIG. 10.
Figure 13:
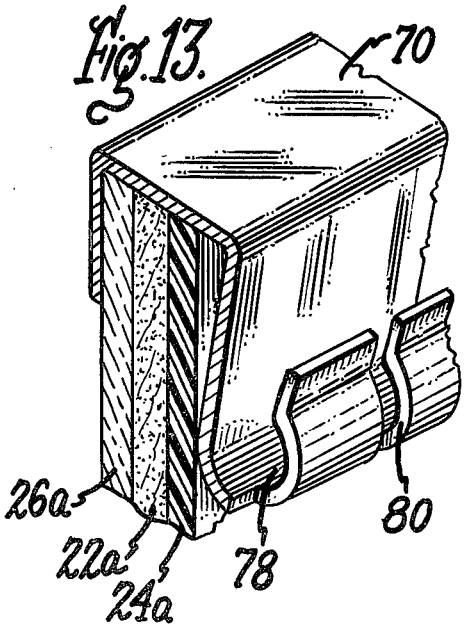
FIG. 13 is a partial perspective view, on an enlarged scale, of the extruded frame member of FIGS. 10 thru 12.

Referring now to FIGS. 10 through 13, another form of frame **10*a* is shown. In this form of the invention, the frame members 70, 72, 74 and 76 are extruded plastic or metal, provided with groove 78, as earlier described. However, the flexible groove 78 is provided with a plurality of slots 80, which may be punched or cut at a set distance along the groove 78, such as for example, one inch. As can be seen, particularly in FIGS. 10 and 11, a wire or cord 82 is first fastened through the corner slots 80, of the adjacent portions of the frame members 70, 76. The wire or cord 82 is then extended across the frame, diagonally to the slots 80 at the adjacent corners of the frame members 72, 74. As can be seen, especially in FIG. 12, cord or wire 82 extends through the end slot 80 of member 72, around groove 78 to member 74, through end slot 80 in member 74 and then back across to the end slot 80 in member 72. From this point it again extends through groove 78 to the end slot 80 of member 76 as shown in FIG. 10. After wrapping around the corner of members 76, 74 the cord 82 is then extended diagonally across the frame to the adjacent corner slots 80 of the frame members 70, 72. Cord or wire 82 may be wrapped in a similar manner about the corner of members 70 and 72. If desired, wire 82 may be extended across the frame between a slot 80 in member 72 and a slot 80 in member 76 to form a hanger wire as indicated at 84 in FIG. 10. Any remaining cord 82 may be wrapped around the grooves 78, as necessary or desired. FIG. 13 shows a partial, perspective view of frame member 70 in use with a picture 22*a* and the backing 24*a* and the glass cover 26*a***.

Figure 14:
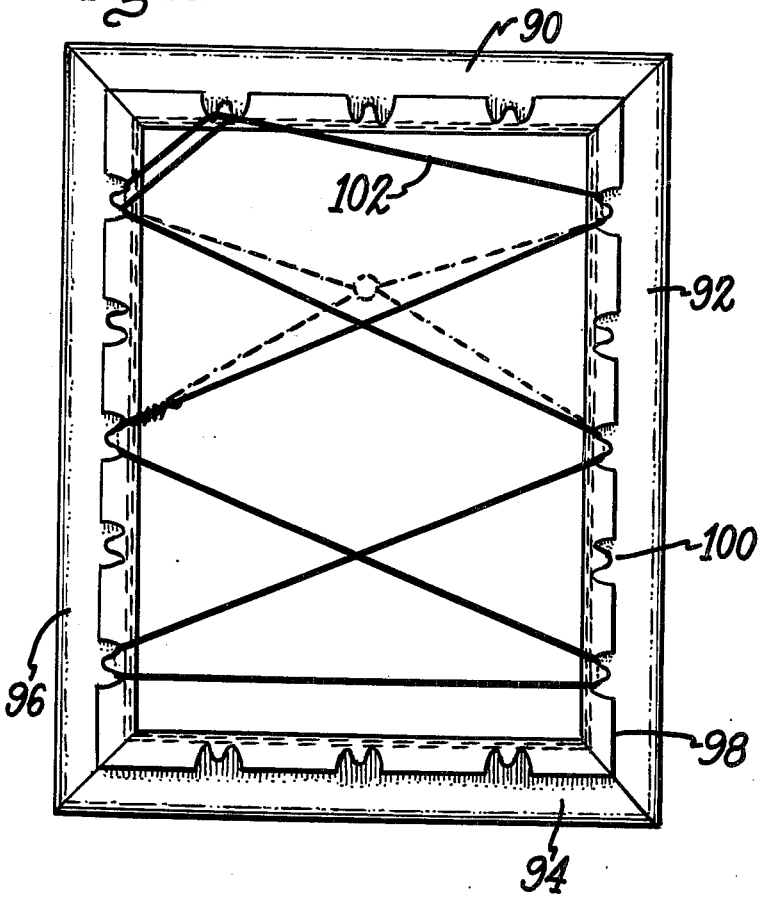
FIG. 14 is a rear plan view of a picture frame with another form of extruded member according to the invention.
Figure 16:
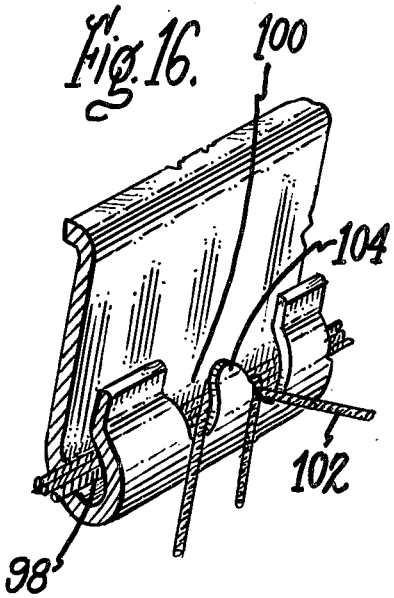
FIG. 16 is a partial perspective view, on an enlarged scale, of the extruded frame member of FIGS. 14 and 15.
Figure 15:
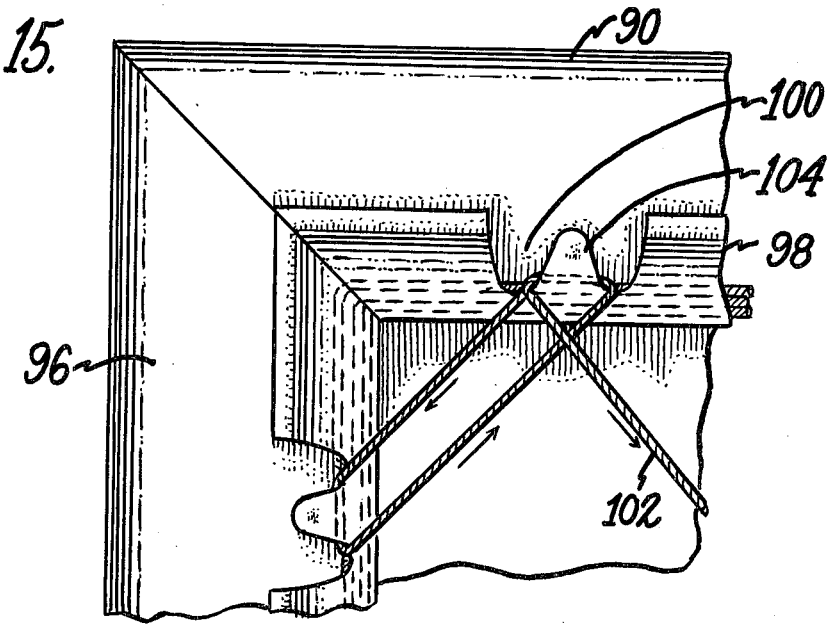
FIG. 15 is an enlarged showing of the upper left-hand corner of the frame of FIG. 14.

FIGS. 14, 15, and 16 show a further modification of the extruded frame members of this invention. As is shown in these FIGURES, frame members 90, 92, 94 and 96 are Z-shaped, as in other forms of the invention. In this modification, the grooves 98 are punched or cut with a plurality of slots or notches 100, which are formed at a set distance along the groove 98. As can be seen the notches 100 are in the form of a W, such that the center 104 of the W may be used to receive a loop of a cord or wire 102, as is shown in FIGS. 14, 15, and 16. Of course, it will be obvious to those skilled in the art, that the cord or wire 102 may be fastened to the notches 100 in a manner similar to that previously described with reference to FIGS. 10 through 13. Due to the use of the W-shaped notch 100, it is possible to loop the cord or wire 102 about the center portion 104 of notch 100 in the manner specially shown in FIG. 15, without the need to wrap about the corners as earlier described. Obviously, the excess cord or wire 102 can be wrapped between the frame members 92, 96, as shown in FIG. 14, after the members 90, 92, 94 and 96 have been secured, either in the manner shown in FIG. 15, or by wrapping about grooves 98, as shown in dotted lines in FIG. 14. By means of the frame members disclosed in FIGS. 10 through 16, there is no need for the securing members disclosed in the earlier FIGURES. These types of frame members would be more useful for single units, which would be cut to the desired size by the customer.

The foregoing has set forth a novel type of Z-shaped frame members which may be used for picture frames. As will be apparent from the description, the frame members may be made in either single pieces or sold as a kit for a given picture size. In either case it will also be clear that the frame may be easily removed from one picture and placed on another picture of the same size, whenever desired. While there has been shown and described the present preferred embodiment of the invention, it will be apparent to those skilled in this art that various modifications may be made without departing from the spirit and scope of the invention, particularly as it is defined in the appended claims.

What is claimed as new and which it is desired to secure by Letters Patent of the United States is:

1. A picture frame comprised of a plurality of generally Z-shaped members, each of said members being extruded from a flexible material and provided with a flexible groove at one end of said Z-shape, said Z-shape adapted to receive at its other end a picture, and means, in the form of a plurality of rod-like members, provided in said groove for fastening a cord or wire to secure the plurality of frame members about the picture.

2. A picture frame as set forth in claim 1 in which said means are flexible right-angular members with a bight formed at the apex of the right angle.

* * * * *